US007493989B2

(12) United States Patent
Aulanko et al.

(10) Patent No.: US 7,493,989 B2
(45) Date of Patent: Feb. 24, 2009

(54) ELEVATOR SUSPENSION ARRANGEMENT

(75) Inventors: Esko Aulanko, Kerava (FI); Jorma Mustalahti, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/437,622

(22) Filed: May 22, 2006

(65) Prior Publication Data

US 2006/0243532 A1 Nov. 2, 2006

Related U.S. Application Data

(63) Continuation of application No. PCT/FI2004/000704, filed on Nov. 22, 2004.

(30) Foreign Application Priority Data

Nov. 24, 2003 (FI) ..... 20031718

(51) Int. Cl.

| | |
|---|---|
| ***B66B 11/08*** | (2006.01) |
| ***H02K 1/22*** | (2006.01) |
| ***H02K 1/12*** | (2006.01) |
| ***H02K 7/00*** | (2006.01) |

(52) U.S. Cl. ..... 187/266; 187/254; 310/67 R; 310/254; 310/261; 310/268; 254/316

(58) Field of Classification Search ..... 187/266, 187/264, 254; 254/290, 316; 310/261, 262, 310/267, 268, 66, 67 R, 254; *B66B 11/04, B66B 1/00, 7/00*

See application file for complete search history.

(56) References Cited

U.S. PATENT DOCUMENTS 641,568 A * 1/1900 Whittier ..... 187/264
646,049 A * 3/1900 Fraser ..... 187/260
912,256 A * 2/1909 Neenan ..... 187/264

(Continued)

FOREIGN PATENT DOCUMENTS

EP 0630849 12/1994

(Continued)

OTHER PUBLICATIONS

International Search Report (PCT/ISA/210).

*Primary Examiner*—Peter M Cuomo
*Assistant Examiner*—Stefan Kruer
(74) *Attorney, Agent, or Firm*—Harness, Dickey & Pierce, P.L.C.

(57) ABSTRACT

The invention relates to a suspension arrangement for an elevator, which elevator preferably is an elevator without machine room and in which elevator the hoisting machine (4) is connected via a traction sheave (5) to hoisting ropes (3), by means of which the elevator car (1) is moved, and which hoisting machine (4) comprises at least a stator frame (26) secured to a mounting place in the elevator shaft and a traction sheave (5) and a rotor frame (25) forming a fixed assembly, which assembly is mounted with bearings so as to be rotatable with respect to the stator frame, and which hoisting machine (4) is secured to a stiffener (22) bracing the stator frame (26). The stiffener (22) comprises a support for mounting a bearing (23), said support being preferably situated below the traction sheave (5) and extending in a direction towards the hoisting machine, on which support is mounted with a bearing a freely rotating auxiliary diverting pulley (7).

41 Claims, 4 Drawing Sheets

Figure 1:
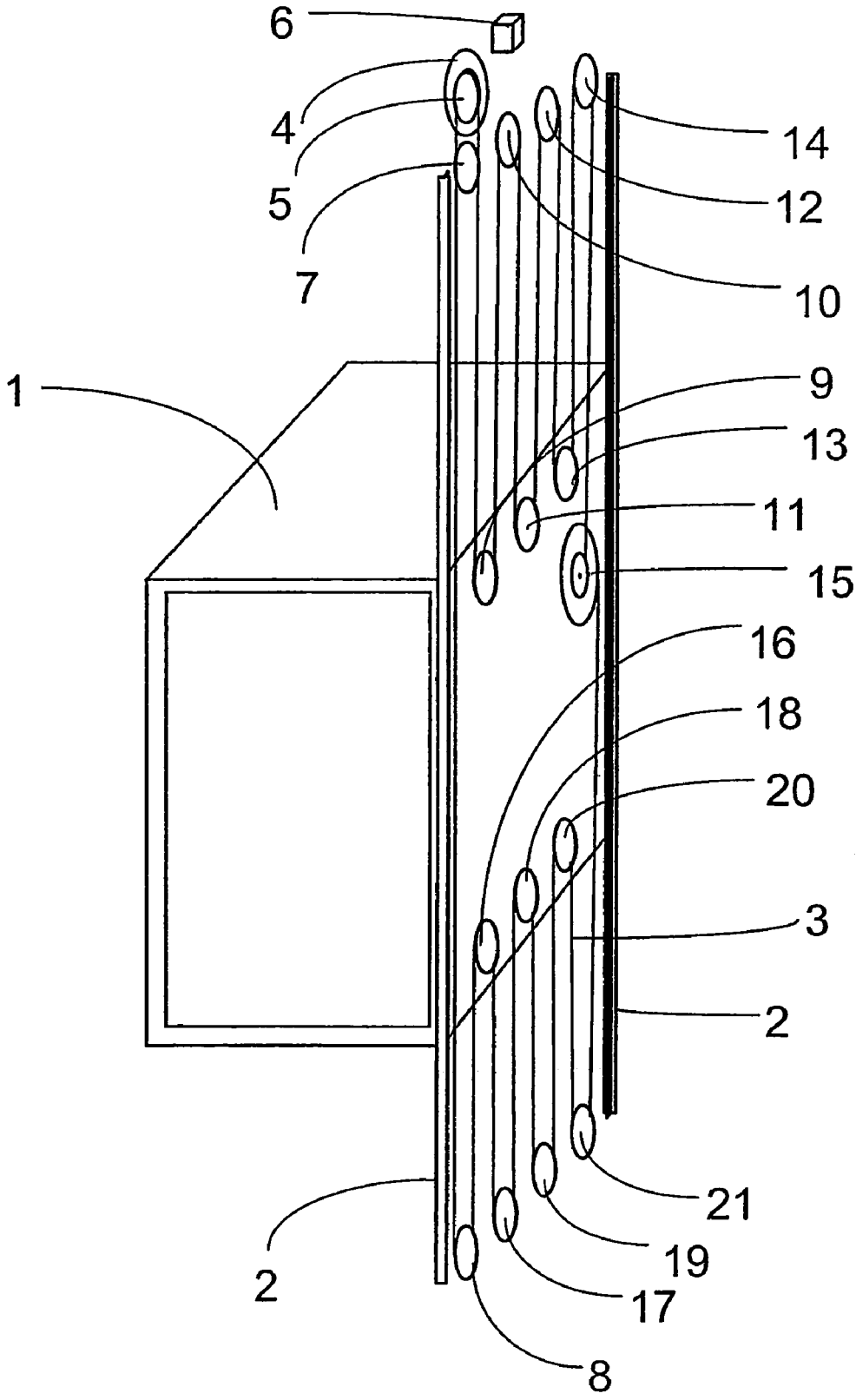

U.S. PATENT DOCUMENTS 4,846,309 A * 7/1989 Nara et al. ..... 254/342
5,361,873 A * 11/1994 de Jong et al. ..... 187/264
5,547,044 A * 8/1996 Yamasaki ..... 187/254
5,573,084 A * 11/1996 Hakala ..... 187/252
5,837,948 A * 11/1998 Aulanko et al. ..... 187/277
5,957,242 A 9/1999 Suter et al.
5,982,060 A * 11/1999 Hakala et al. ..... 310/67 R
6,193,017 B1 * 2/2001 Koster ..... 187/258
2003/0159891 A1 * 8/2003 Ach et al. ..... 187/266

FOREIGN PATENT DOCUMENTS

EP 1327598 7/2003
EP 1472170 1/2007
WO WO 9933742 A1 * 7/1999
WO WO 03/066498 1/2003

* cited by examiner

ELEVATOR SUSPENSION ARRANGEMENT

This application is a continuation of PCT/FI2004/000704, filed Nov. 22, 2004, which is an international application of Finish Patent Application No. 20031718 filed on Nov. 24, 2003, the disclosure of which is incorporated herein by reference in its entirety.

SPECIFICATION

The present invention relates to elevator suspension arrangements and to elevator hoisting machines.

The present invention concerns in the first place an elevator without machine room and provided with a substantially flat discoid hoisting machine, in which elevator the hoisting machine is mounted e.g. on one or more guide rails in the elevator shaft. The invention relates in particular to so-called Double Wrap suspension, which is used e.g. in traction sheave machines provided with a coating to improve the frictional engagement between the traction sheave and the hoisting ropes.

Previously known is e.g. an elevator solution without machine room as disclosed in specification WO 03/066498, wherein a gearless hoisting machine having an axial length larger than the diameter of the machine is mounted on guide rails in an elevator shaft. One end of the machine is supported on a counterweight guide rail while the other end is supported on a car guide rail, the guide rail lines of the guide rails being perpendicular to each other. In addition, a diverting pulley is provided below the machine for so-called Double Wrap roping. The diverting pulley is placed in a typical manner in the rope suspension and the diverting pulley is aligned at installation time very accurately with the traction sheave to ensure a correct passage of the ropes.

A drawback with the disclosed solution is the space required in the elevator shaft due to the placement of the machine. The size of the machine itself and the size of the mounting of the machine take up space in the cross-sectional area of the elevator and thus reduce e.g. the cross-sectional area of the elevator that can be accommodated in the shaft. An additional drawback is that the auxiliary diverting pulley required in the Double Wrap solution has to be aligned at an exactly correct angle relative to the position of the traction sheave. This aligning has to be done accurately, so it is difficult and takes time in cramped shaft conditions. Moreover, special tools may be needed. As a consequence of the above circumstances, the aligning is on the whole a relatively expensive operation.

The object of the present invention is to overcome the above-mentioned drawbacks and to achieve a space-saving elevator suspension arrangement of economical cost that will make it possible to install an auxiliary diverting pulley for Double Wrap suspension below the traction sheave in an exactly correct position without time-consuming and difficult adjustments. A further object of the suspension arrangement of the invention is to enable the aforesaid auxiliary diverting pulley to be secured in conjunction with the hoisting machine without separate and voluminous mounting solutions.

The elevators and elevator hoisting machines of the invention are described below. Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts.

The elevator hoisting machine suspension arrangement and the hoisting machine of the invention provide the advantage of a sturdy mounting solution in which the auxiliary diverting pulley to be installed in conjunction with it can be automatically mounted at an exactly correct setting angle relative to the position of the traction sheave without any adjustments of setting angles. A further advantage is that no separate mounting structures are needed for mounting the auxiliary diverting pulley, because such separate mounting structures always require a strong steel structure to which the diverting pulley is secured. In addition, mounting the auxiliary diverting pulley in conjunction with the hoisting machine reduces the overall space requirement of the hoisting machine and the auxiliary diverting pulley. This allows a saving of transverse space in the elevator shaft, so that it is possible e.g. to place an elevator car of a larger cross-section in the same space.

The elevator hoisting machine of the invention comprises at least a stator frame and a rotor frame that forms a fixed assembly with the traction sheave, which assembly is mounted on bearings so as to be rotatable with respect to the stator frame. The hoisting machine is secured to a stiffener bracing the stator frame. The stiffener comprises a support for a bearing, said support being preferably situated below the traction sheave and extending in a direction towards the hoisting machine, on which support is mounted with a bearing a freely rotatable auxiliary diverting pulley.

Figure 2:
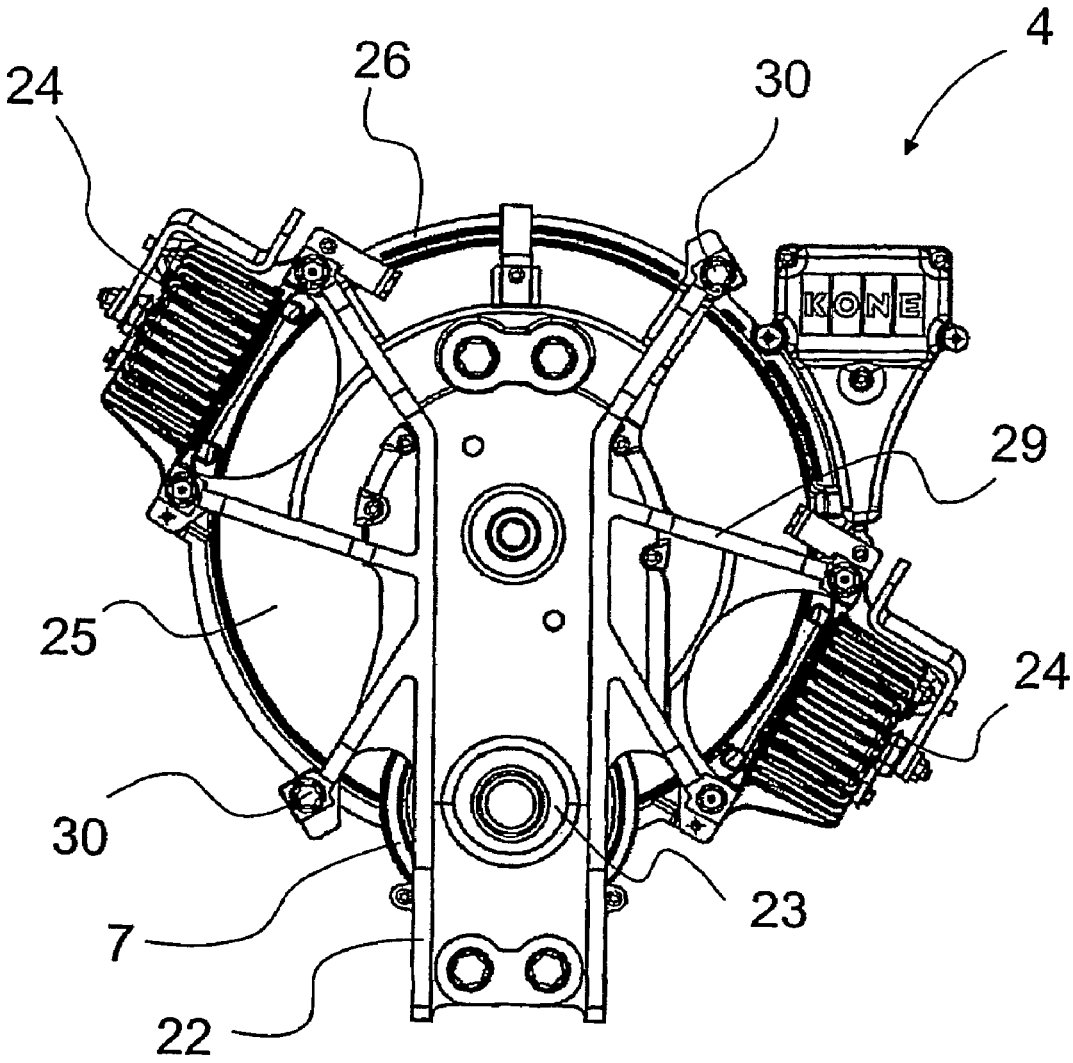
Figure 3:
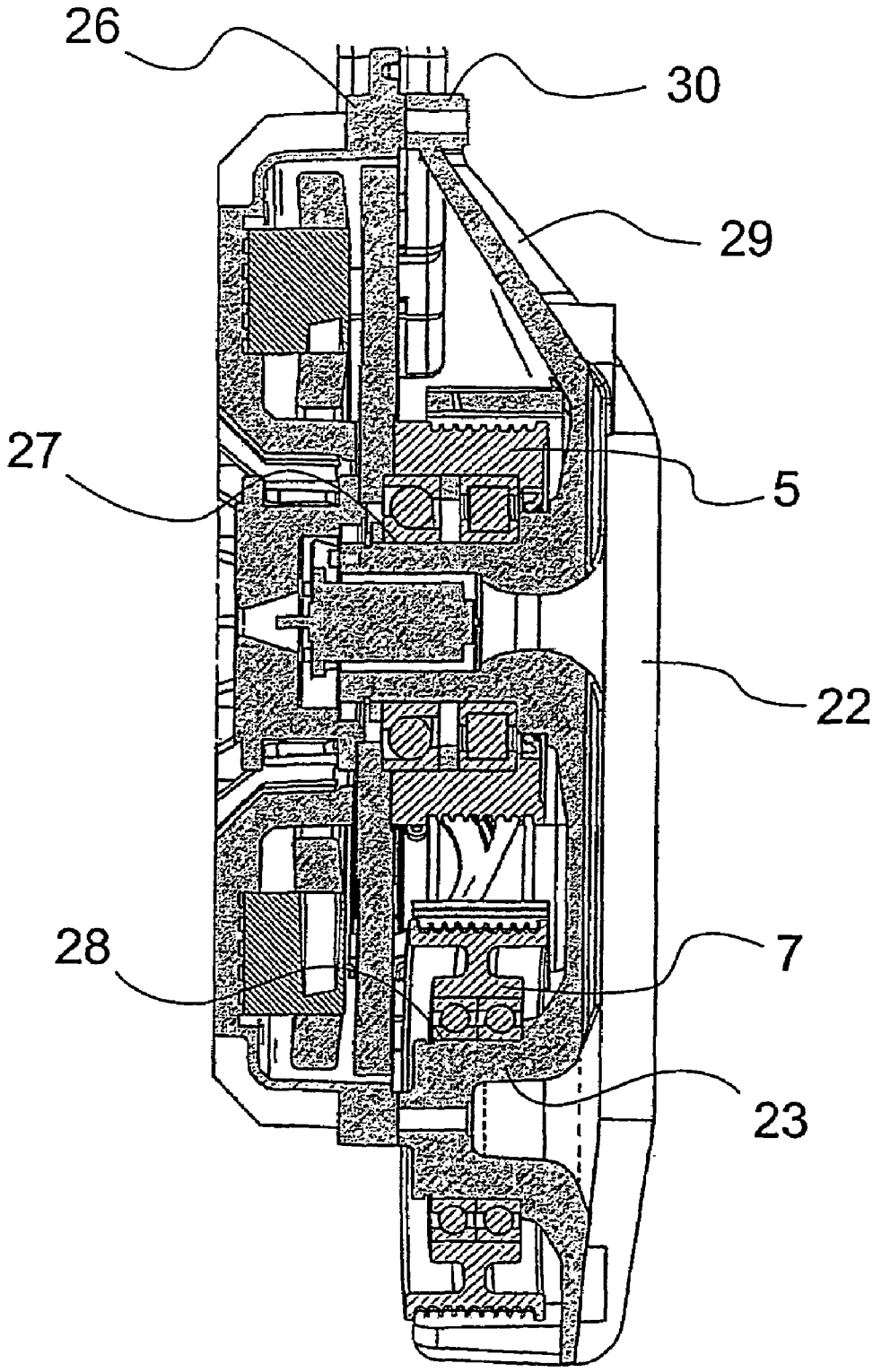
Figure 4:
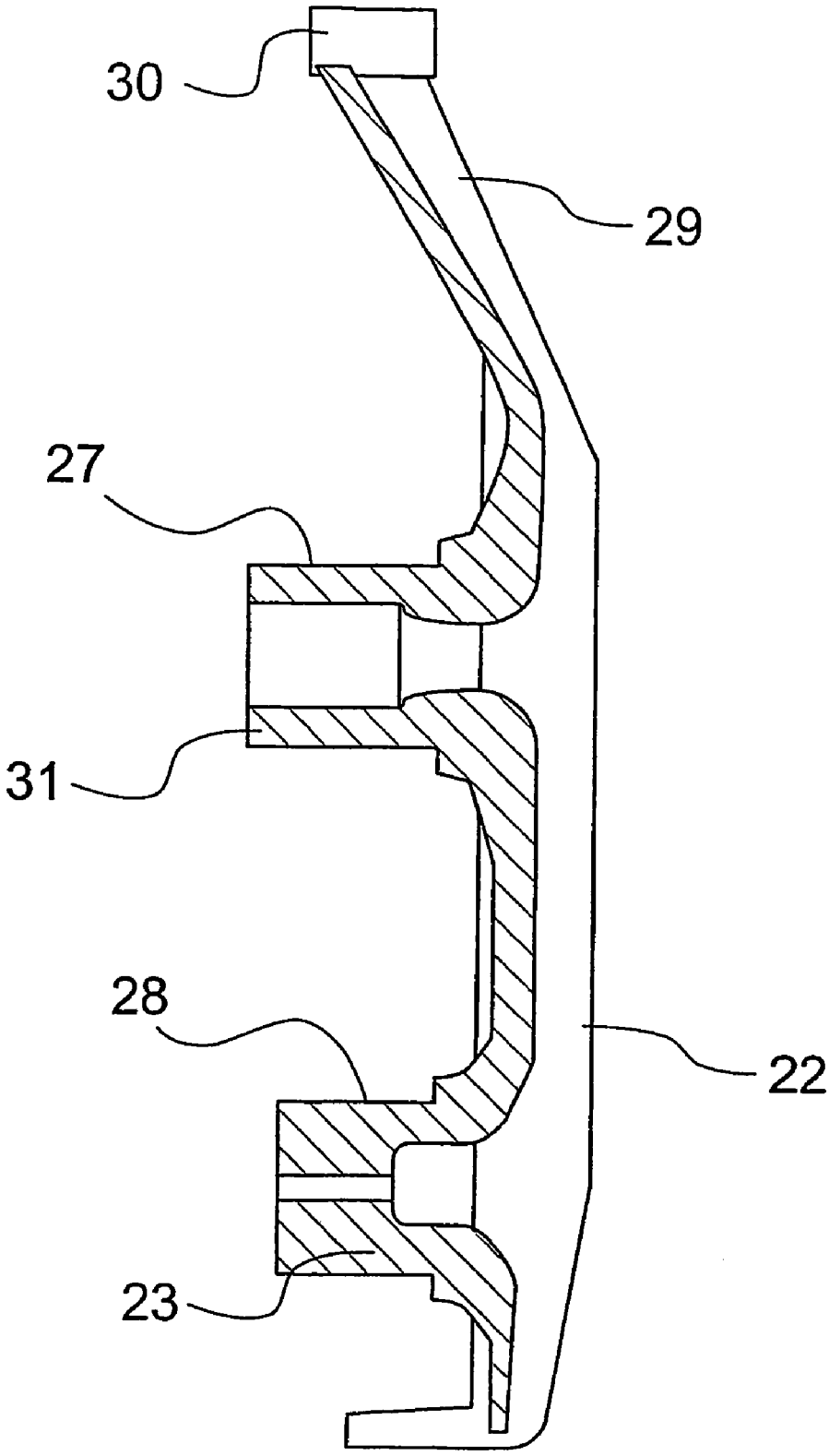

In the following, the invention will be described in detail with reference to an embodiment example and the attached drawings, wherein FIG. 1 is a general representation of an traction sheave elevator without counterweight according to the invention, seen in an oblique top view, FIG. 2 presents a hoisting machine according to the invention in front view, FIG. 3 presents a more detailed side view of a placement according to the invention of an auxiliary diverting pulley in conjunction with the hoisting machine, seen in a sectioned view, and FIG. 4 presents a sectioned side view of a stator frame stiffener according to the invention.

FIG. 1 presents a general view of a traction sheave elevator without counterweight according to the invention, wherein the elevator is preferably an elevator without machine room and with a drive machine 4 placed in the elevator shaft. The elevator presented in the figure is a traction sheave elevator without counterweight and with machine above, in which the elevator car 1 moves along guide rails 2. The elevator presented in FIG. 1 is a side rucksack-type elevator in which the elevator guide rails 2, hoisting machine 4, diverting pulleys, rope compensating device 15 and hoisting ropes 3 are arranged on one side of the elevator car 1, which in this case is located to the right of the elevator car 1 as seen from the door opening towards the elevator shaft. This arrangement can also be implemented on any side of the elevator car 1, such as e.g. in the case of a rucksack solution in the space between the back wall of the elevator car and the elevator shaft. The elevator can also be implemented by placing the guide rails of the elevator car and some of the diverting pulleys on different sides of the elevator car.

In FIG. 1, the hoisting ropes run as follows: One end of the hoisting ropes is secured to the sheave of smaller diameter in a compensating device 15 placed on the elevator car, which sheave is immovably fitted fast to a sheave of larger diameter. From the compensating device 15, the hoisting ropes 3 go upwards and meet a diverting pulley 14 placed above the elevator car in the elevator shaft, preferably in the upper part of the elevator shaft, passing around it along rope grooves provided on the diverting pulley 14. These rope grooves may be coated or uncoated. The coating used is e.g. a friction-increasing material, such as polyurethane or some other appropriate material. From diverting pulley 14, the ropes go further downwards to a diverting pulley 13 fitted in place on the elevator car, and having passed around this pulley the ropes go further upwards to a diverting pulley 12 fitted in place in the upper part of the elevator shaft. Having passed around diverting pulley 12, the ropes come again downwards to a diverting pulley 11 fitted in place on the elevator car, pass around it and go further upwards to a diverting pulley 10 fitted in place in the upper part of the elevator shaft, and having passed around this pulley the hoisting ropes 3 go further downwards to a diverting pulley 9 fitted in place on the elevator car. Having passed around this pulley 9, the ropes 3 go further upwards in tangential contact with an auxiliary diverting pulley 7 to the traction sheave 5.

The auxiliary diverting pulley 7 is preferably fitted in conjunction with the hoisting machine 4, near and below the traction sheave 5. Between the auxiliary diverting pulley 7 and the traction sheave 5, the figure shows Double Wrap (DW) roping, in which roping the hoisting ropes 3 run in tangential contact with the auxiliary diverting pulley 7 upwards to the traction sheave 5 and, having passed around the traction sheave 5, the hoisting ropes return to the auxiliary diverting pulley 7, pass around it and go back to the traction sheave 5.

In Double Wrap roping, when the auxiliary diverting pulley 7 is substantially the same size with the traction sheave 5, the auxiliary diverting pulley 7 can also function as a damping pulley. In this case, the ropes going from the traction sheave 5 to the elevator car 1 pass via the rope grooves of the auxiliary diverting pulley 7 and the deflection of the rope caused by the auxiliary diverting pulley is very small. It could be stated that the ropes going from the traction sheave and the ropes coming to it only run in "tangential contact" with the auxiliary diverting pulley. Such "tangential contact" functions as a solution damping vibrations of the outgoing ropes and it can also be applied in other roping solutions.

Diverting pulleys 14, 13, 12, 11, 10, 9, 7 together with the traction sheave 5 of the hoisting machine and the compensating device 15 form the suspension above the elevator car, which has the same suspension ratio as the suspension below the elevator car, which in FIG. 1 is 7:1.

From the traction sheave 5, the ropes go further in tangential contact with the auxiliary diverting pulley 7 to a diverting pulley 8, which is preferably fitted in place in the lower part of the elevator shaft. Having passed around diverting pulley 8, the ropes 3 go further upwards to a diverting pulley 16 fitted in place on the elevator car, and having passed around this pulley the ropes go further downwards to a diverting pulley 17 in the lower part of the elevator shaft, pass around it and return to a diverting pulley 18 fitted in place on the elevator car. Having passed around diverting pulley 18, the hoisting ropes 3 go further downwards to a diverting pulley 19 in the lower part of the elevator shaft and, having passed around this pulley, the ropes go further upwards to a diverting pulley 20 on the elevator car. Having passed around diverting pulley 20, the hoisting ropes 3 go further downwards to a diverting pulley 21 fitted in place in the lower part of the elevator shaft, pass around it and go further upwards to the compensating device 15 fitted in place on the elevator car, the second end of the hoisting ropes being secured to the sheave of larger diameter in the compensating device. Diverting pulleys 8, 16, 17, 18, 19, 20, 21 and the compensating device 15 form the hoisting rope suspension below the elevator car.

The hoisting machine 4 and traction sheave 5 of the elevator and/or auxiliary diverting pulley 7 and diverting pulleys 10, 12, 14 in the upper part of the elevator shaft may be mounted in place on a frame structure formed by the guide rails 2 or on a beam structure at the upper end of the elevator shaft or separately in the elevator shaft or on some other appropriate mounting arrangement. The diverting pulleys in the lower part of the elevator shaft may be mounted in place on a frame structure formed by the guide rails 2 or to a beam structure placed at the lower end of the elevator shaft or separately in the lower part of the elevator shaft or on some other appropriate mounting arrangement. The diverting pulleys on the elevator car may be mounted in place on the frame structure of the elevator car 1 or to a beam structure or beam structures in the elevator car or separately on the elevator car or some other appropriate mounting arrangement. The compensating device 15 as illustrated in FIG. 1, used as a rope elongation compensating assembly and functioning as a tensioning sheave assembly, can also be advantageously placed to replace diverting pulley 21 on the bottom of the shaft, which pulley is preferably secured in place to the floor of the shaft, or diverting pulley 14 in the upper part of the shaft, which pulley is preferably secured in place to the ceiling of the shaft if an even suspension ratio is used, in which case the compensating device is not mounted in conjunction with the elevator car. In this case, the number of diverting pulleys needed is smaller by one. In advantageous cases, this also allows easier and faster installation of the elevator.

In the embodiment example according to the invention, an elevator hoisting machine e.g. as presented in FIG. 2 is used. The hoisting machine comprises at least a stator frame 26 secured to a guide rail 2 in the elevator shaft and an assembly consisting of a traction sheave 5 and a rotor frame 25, said rotor frame having preferably a substantially discoid shape and said rotor frame being mounted on bearings so as to be rotatable with respect to the stator frame 26. Secured to the stator frame 26 is a stiffener 22 bracing the stator frame, which stiffener, when mounted in the elevator shaft, is substantially vertical and extends along the center line of the stator frame substantially over the entire stator frame. The stiffener 22 may form an integral part of the stator frame 26, i.e. it may be part of the same casting, or the stiffener may be a separate body secured to the stator frame. In FIG. 2, the stiffener 22 is a separate body with a number of supporting brackets 29 extending from its central part in different directions, the outer end of each bracket being connected to the stator frame 26 by means of a fastening part 30. In addition, the stiffener 22 or the stator frame 26 comprises at least one brake 24 serving as the brake of the elevator. The brake 24 may simultaneously function as a mass body that has been arranged to make the mass distribution and bending stiffness of the stator frame substantially unsymmetrical to suppress undesirable vibrations.

The lower part of the stiffener 22 stiffening and bracing the hoisting machine is close to the traction sheave 5, at a suitable distance below the traction sheave a support 23 for a bearing, said support being preferably a cylindrical projection extending from the stiffener 22 towards the hoisting machine. The support 23 constitutes an axle for the auxiliary diverting pulley 7, which is mounted with a bearing on the support 23 below the traction sheave 5 so as to be freely rotatable. The auxiliary diverting pulley 7 makes it possible to use so-called Double Wrap suspension, which can be utilized to increase the contact angle on the traction sheave 5 and thereby the gripping force achieved via friction. In such Double Wrap suspension, the ropes 3 coming to the traction sheave run tangentially past the auxiliary diverting pulley 7 as explained above.

FIG. 3 presents a vertically sectioned hoisting machine 4 and FIG.4 presents a vertically sectioned stiffener 22 partially integrated with the stator frame. In FIG. 3, the vertical section of the hoisting machine is not taken along a plane passing directly via the center line. FIG. 3 also shows the stator frame 26 secured to the stiffener 22. The traction sheave 5 is shown in a sectioned form and rotatably mounted on the bearing surface 27 of the support for the traction sheave bearing 31 on the stiffener 22, said support being preferably a cylindrical projection. The support for the traction sheave bearing 31 is integrated with the stiffener 22 and extends from the stiffener towards the hoisting machine, forming the axle of the traction sheave 5. The auxiliary diverting pulley 7 below the traction sheave 5 is mounted with a bearing on a bearing surface 28 machined on the cylindrical support 23 permanently integrated with the stiffener 22,which bearing surface has been machined at the desired angle to the corresponding bearing surface 27 for the traction sheave 5, which bearing surface has likewise been integrated with and machined in the stiffener 22. In other words, both bearing surfaces have been machined at a desired angle to each other during manufacture of the stiffener 22. Therefore, both the traction sheave 5 and the auxiliary diverting pulley 7 can be automatically mounted at the correct angle relative to each other during installation.

It is obvious to the person skilled in the art that the invention is not limited to the example described above, but that it may be varied within the scope of the claims presented below. Thus, the invention is not necessarily limited even to Double Wrap type elevators, but the elevator suspension arrangement can be implemented in the same way even in Single Wrap type elevators in which the auxiliary diverting pulley is disposed in the same way as described above but the hoisting ropes are passed only once around the traction sheave, so the contact angle of the rope on the traction sheave is about 180°. The auxiliary diverting pulley below the traction sheave is only used for "tangential contact" of the rope in the manner described above, in which case the auxiliary diverting pulley functions as a rope guide and a damping sheave suppressing vibrations. The hoisting ropes may also be passed crosswise by means of the auxiliary diverting pulley, in which case a contact angle larger than 180° on the traction sheave is obtained.

It is further obvious to the person skilled in the art that the place and method of suspension may differ from the above description. Instead of being mounted on a guide rail, the hoisting machine may be mounted on a supporting beam connecting the guide rails, or the hoisting machine may be mounted on any part suited for use as a mounting point in the shaft, e.g. on a wall of the elevator shaft. Similarly, the structure and integration of the stiffener with the stator frame may differ from the above description. It is additionally obvious that the solution of the invention can as well be applied in elevator solutions provided with a counterweight.

The invention claimed is:

1. A suspension arrangement for an elevator, the suspension arrangement comprising:
- a hoisting machine;
- hoisting ropes;
- a stiffener;
- a first bearing; and
- a pulley;
- wherein the hoisting machine includes:
  - a stator frame; and
  - an assembly;
- wherein the stator frame is adapted to be secured in an elevator shaft,
- wherein the assembly includes:
  - a traction sheave; and
  - a rotor frame;
- wherein the traction sheave is fixed to the rotor frame,
- wherein the assembly is adapted to rotate with respect to the stator frame,
- wherein the hoisting machine is secured to the stiffener bracing the stator frame so that the assembly is between the stator frame and the stiffener,
- wherein the stiffener includes a first support adapted to mount the first bearing,
- wherein the first bearing is adapted to mount the pulley,
- wherein the pulley, the first bearing, the hoisting machine, and the stiffener are adapted to automatically align the pulley with the traction sheave when the pulley is mounted on the first bearing and the hoisting machine is secured to the stiffener, and
- wherein the suspension arrangement is adapted to suspend an elevator without a counterweight.

2. The suspension arrangement of claim 1, wherein the stiffener further includes:
- a second support for mounting a second bearing;
- wherein the assembly is adapted to rotate with respect to the stator frame using the second bearing.

3. The suspension arrangement of claim 1, wherein the hoisting machine is adapted to be secured, directly or indirectly, to one or more guide rails of an elevator car.

4. The suspension arrangement of claim 1, wherein the hoisting machine is adapted to be secured at an elevation above an elevator car.

5. The suspension arrangement of claim 1, wherein the stiffener is a solid casting.

6. The suspension arrangement of claim 1, wherein the elevator is an elevator without machine room.

7. The suspension arrangement of claim 1, wherein the elevator is an elevator with machine room.

8. The suspension arrangement of claim 2, wherein bearing surfaces of the first and second supports are machined during manufacture of the stiffener.

9. The suspension arrangement of claim 2, wherein the traction sheave is mounted on the second bearing of the second support, and
- wherein bearing surfaces of the first and second supports are machined so that the pulley is mounted on the first bearing at a desired angle relative to the traction sheave mounted on the second bearing.

10. A suspension arrangement for an elevator, the suspension arrangement comprising:
- a hoisting machine;
- hoisting ropes;
- a stiffener;
- a first bearing;
- a pulley; and
- a compensation device;
- wherein the hoisting machine includes:
  - a stator frame; and
  - an assembly;
- wherein the stator frame is adapted to be secured in an elevator shaft,
- wherein the assembly includes:
  - a traction sheave; and
  - a rotor frame;
- wherein the traction sheave is fixed to the rotor frame,
- wherein the assembly is adapted to rotate with respect to the stator frame, wherein the hoisting machine is secured to the stiffener bracing the stator frame so that the assembly is between the stator frame and the stiffener, wherein the stiffener includes a first support adapted to mount the first bearing, wherein the first bearing is adapted to mount the pulley, wherein the pulley, the first bearing, the hoisting machine, and the stiffener are adapted to automatically align the pulley with the traction sheave when the pulley is mounted on the first bearing and the hoisting machine is secured to the stiffener, and wherein the compensation device compensates for elongation of the hoisting ropes, tensions the hoisting ropes, or compensates for elongation of the hoisting ropes and tensions the hoisting ropes.

11. The suspension arrangement of claim 10, wherein the compensation device comprises:

a first sheave; and a second sheave;

wherein the first sheave has a smaller diameter than the second sheave.

12. The suspension arrangement of claim 10, wherein the compensation device is adapted to be attached to an elevator car.

13. The suspension arrangement of claim 10, wherein the compensation device is adapted to be disposed in the elevator shaft at an elevation above an elevator car.

14. The suspension arrangement of claim 10, wherein the compensation device is adapted to be disposed in the elevator shaft at an elevation below an elevator car.

15. The suspension arrangement of claim 10, wherein a suspension ratio above an elevator car is the same as a suspension ratio below the elevator car.

16. The suspension arrangement of claim 10, wherein a suspension ratio above an elevator car is even, and wherein a suspension ratio below the elevator car is even.

17. The suspension arrangement of claim 10, wherein a suspension ratio above an elevator car is odd, and wherein a suspension ratio below the elevator car is odd.

18. The suspension arrangement of claim 10, wherein the stiffener further includes:

a second support for mounting a second bearing;

wherein the assembly is adapted to rotate with respect to the stator frame using the second bearing.

19. The suspension arrangement of claim 10, wherein the hoisting machine is adapted to be secured, directly or indirectly, to one or more guide rails of an elevator car.

20. The suspension arrangement of claim 10, wherein the hoisting machine is adapted to be secured at an elevation above an elevator car.

21. The suspension arrangement of claim 10, wherein the stiffener is a solid casting.

22. The suspension arrangement of claim 10, wherein the elevator is an elevator without machine room.

23. The suspension arrangement of claim 10, wherein the elevator is an elevator with machine room.

24. The suspension arrangement of claim 10, wherein the elevator is an elevator with counterweight.

25. The suspension arrangement of claim 10, wherein the elevator is an elevator without counterweight.

26. The suspension arrangement of claim 18, wherein bearing surfaces of the first and second supports are machined during manufacture of the stiffener.

27. The suspension arrangement of claim 18, wherein the traction sheave is mounted on the second bearing of the second support, and wherein bearing surfaces of the first and second supports are machined so that the pulley is mounted on the first bearing at a desired angle relative to the traction sheave mounted on the second bearing.

28. A suspension arrangement for an elevator, the suspension arrangement comprising:

a hoisting machine;

hoisting ropes;

a stiffener;

a first bearing; and a first pulley;

wherein the hoisting machine includes:

a stator frame; and an assembly;

wherein the stator frame is adapted to be secured in an elevator shaft, wherein the assembly includes:

a traction sheave; and a rotor frame;

wherein the traction sheave is fixed to the rotor frame, wherein the assembly is adapted to rotate with respect to the stator frame, wherein the hoisting machine is secured to the stiffener bracing the stator frame so that the assembly is between the stator frame and the stiffener, wherein the stiffener includes a first support adapted to mount the first bearing, wherein the first bearing is adapted to mount the first pulley, and wherein the first pulley, the first bearing, the hoisting machine, and the stiffener are adapted to automatically align the first pulley with the traction sheave when the first pulley is mounted on the first bearing and the hoisting machine is secured to the stiffener, and wherein the suspension arrangement is adapted to suspend a rucksack-type elevator.

29. The suspension arrangement of claim 28, wherein guide rails of the elevator are disposed on one side of an elevator car.

30. The suspension arrangement of claim 28, further comprising:

additional pulleys;

wherein the additional pulleys are disposed on one side of an elevator car.

31. The suspension arrangement of claim 28, further comprising:

additional pulleys;

wherein guide rails of the elevator are disposed on one side of an elevator car, and wherein the additional pulleys are disposed on the one side of the elevator car.

32. The suspension arrangement of claim 28, wherein the stiffener further includes:

a second support for mounting a second bearing;

wherein the assembly is adapted to rotate with respect to the stator frame using the second bearing.

33. The suspension arrangement of claim 28, wherein the hoisting machine is adapted to be secured, directly or indirectly, to one or more guide rails of an elevator car.

34. The suspension arrangement of claim 28, wherein the hoisting machine is adapted to be secured at an elevation above an elevator car.

35. The suspension arrangement of claim 28, wherein the stiffener is a solid casting.

36. The suspension arrangement of claim 28, wherein the elevator is an elevator without machine room.

37. The suspension arrangement of claim 28, wherein the elevator is an elevator with machine room.

38. The suspension arrangement of claim 28, wherein the elevator is an elevator with counterweight.

39. The suspension arrangement of claim 28, wherein the elevator is an elevator without counterweight.

40. The suspension arrangement of claim 32, wherein bearing surfaces of the first and second supports are machined during manufacture of the stiffener.

41. The suspension arrangement of claim 32, wherein the traction sheave is mounted on the second bearing of the second support, and wherein bearing surfaces of the first and second supports are machined so that the first pulley is mounted on the first bearing at a desired angle relative to the traction sheave mounted on the second bearing.

* * * * *